United States Patent [19]

Teske et al.

[11] Patent Number: 4,676,431

[45] Date of Patent: Jun. 30, 1987

[54] TRASH CONTAINER

[76] Inventors: John E. Teske, S51 W30765 Walnut, Mukwonago, Wis. 53149; Curt D. Beckman, 2768 Kings Pkwy., East Troy, Wis. 53120; Thomas C. Warner, 8006 Big Bend Rd., Waterford, Wis. 53186; Keith A. Pine, Rte. 5, Box 90, Elkhorn, Wis. 53121

[21] Appl. No.: 942,802

[22] Filed: Dec. 17, 1986

[51] Int. Cl.[4] ..... B65D 90/00

[52] U.S. Cl. ..... 232/43.1; 220/1 T

[58] Field of Search ..... 232/43.1; 220/1 T

[56] References Cited

U.S. PATENT DOCUMENTS 1,831,687 11/1931 Ross ..... 232/43.1
2,942,751 6/1960 Dempster ..... 232/43.1 X
3,141,609 7/1964 Roth ..... 232/43.1
4,151,928 5/1979 Fagliano et al. ..... 220/1 T X
4,199,075 4/1980 Rohrer ..... 22/1 T X

*Primary Examiner*—Robert W. Gibson, Jr.
*Attorney, Agent, or Firm*—James L. Kirschnik

[57] ABSTRACT

A large trash container has a horizontal pivot bar on one end and lift ring on the opposite end for permitting the container to be emptied into a rear loading truck having a winch for pivoting the container around the pivot bar when the lift ring is winched upward. Pivotable covers on the container open under the influence of gravity to discharge trash as the container is tipped. Side brackets are also attached to the container which may be engaged by lifting forks of a front loading truck for lifting and tilting the container to discharge the contents into a truck mounted receptacle.

5 Claims, 4 Drawing Figures

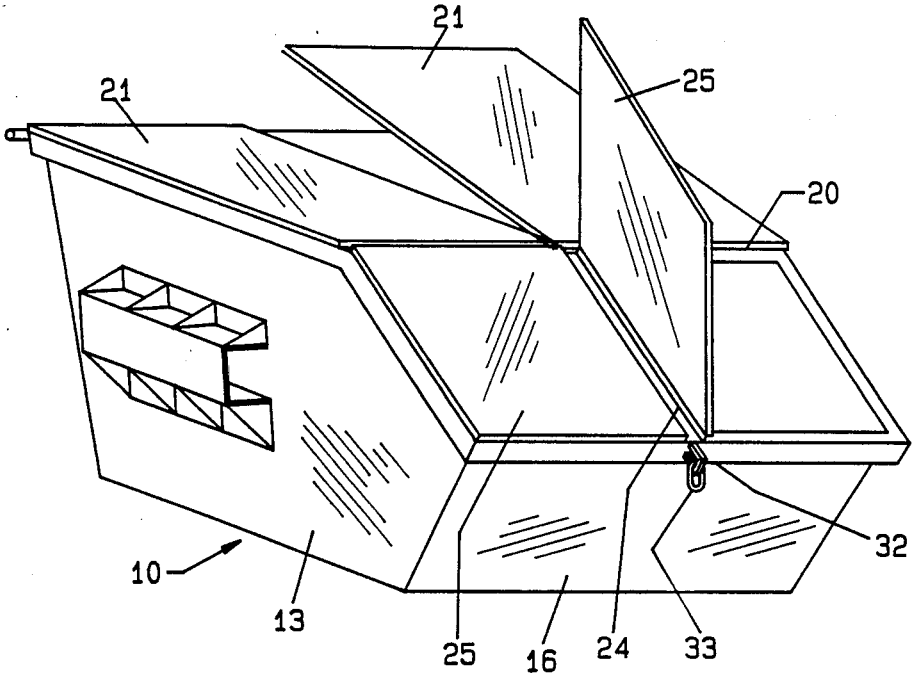
FIG. #1
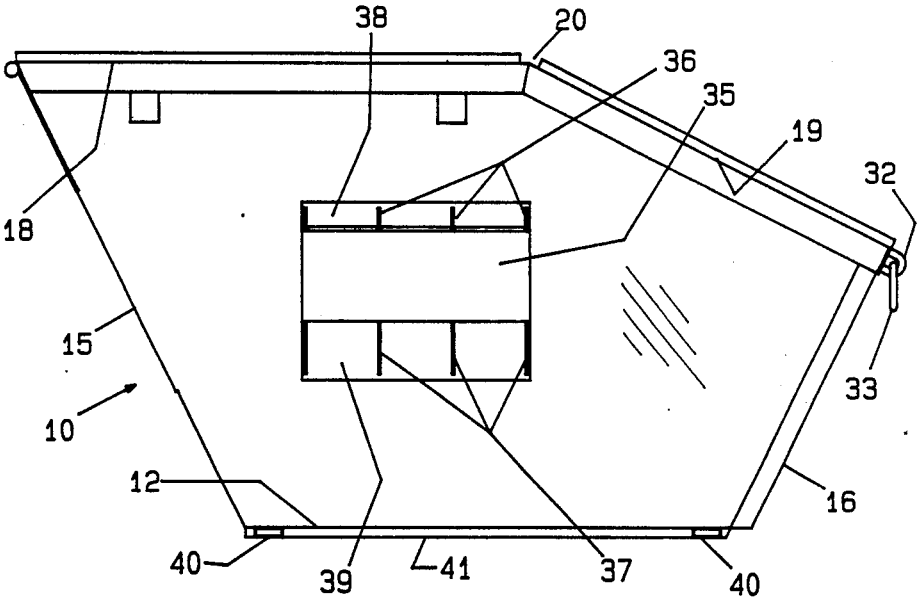
FIG. #2

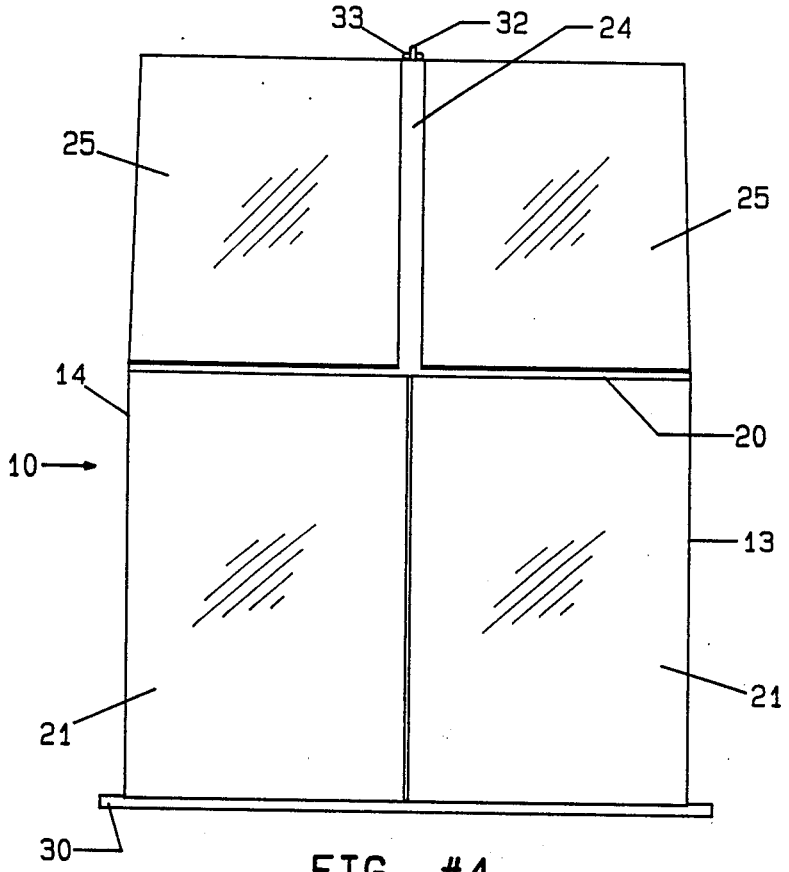
FIG. #4
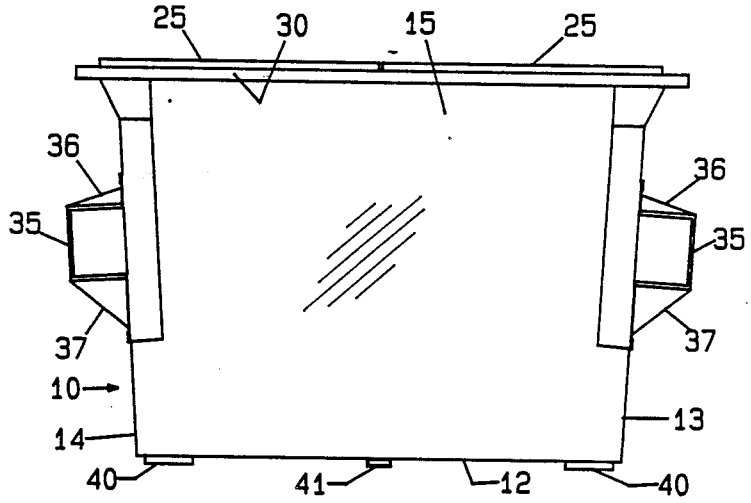
FIG. #3

TRASH CONTAINER

BACKGROUND OF THE INVENTION

1. Field of the Invention

The present invention relates to large trash containers adapted to be emptied into trucks by raising and tipping the container to discharge its contents.

2. Background Information

For many commercial operations and large residential users of trash services, a large stationary container is often provided to receive trash. Typically the containers consist of a large steel receptacle having access doors for depositing the trash and also for permitting the trash to be emptied. Such containers are generally adapted to be mechanically raised by a waste disposal truck equipped to tip the container to a position where the trash will discharge by gravity into the truck.

The common practice in the waste disposal industry is to offer two choices of trucks. The first and generally older style of truck consists of a rear loading truck in which one end of the container is pivoted under the influence of a winch and cable hooked to the opposite end of the container. The truck driver will normally back up to the container, attach the winch cable and hook and then tip the container upward to a sufficient angle to cause the trash within the container to discharge by gravity into the truck.

In more recent years, the trend has been to utilize front loading trucks having a pair of forks extending forwardly and adapted to engage brackets on the sides of a trash container. The forks are adapted to lift the entire container up and over the front of the truck and to tip it backward at a sufficient angle to discharge the container contents into the truck. While the front loading mode of emptying such containers is generally preferred because of the speed with which it can be accomplished, many waste disposal companies still have rear load trucks in addition to front loading trucks.

Currently, the most common trash containers of this type have either a four or six yard volume, however, current designs of containers for rear load trucks are not adaptable or functional for front load trucks. Conversely, the front load type container designs are not adaptable to be used with rear load trucks.

SUMMARY OF THE INVENTION

The present invention provides a large waste disposal container configured to be emptied by either a front loading vehicle or a rear loading vehicle from the same side of the container. The container has a pivot bar and eye assembly for facilitating back loading disposal, and also has side brackets for being emptied by conventional front loading vehicles.

DESCRIPTION OF THE DRAWINGS

FIG. 1 is a perspective view of a container assembly according to the invention;

FIG. 2 is a side elevation view of a container according to the invention;

FIG. 3 is a front elevation of a container according to the invention; and,

FIG. 4 is a top view of a container according to the invention.

DESCRIPTION OF A PREFERRED EMBODIMENT

With reference to FIGS. 1 through 4, a container 10 according to the invention comprises a rectangular bottom plate 12 having upstanding side members 13 and 14 interconnected to upstanding front and back plates 15 and 16 respectively to form a generally hollow container. The side walls 13 and 14 have a generally horizontally extending edge portion 18 extending from the front plate 15 to a point approximately midway across the side wall at which point the side walls 13 and 14 have a downwardly tapering edge 19 extending to the back plate 16. A horizontally extending pivot point 20 connects the junctions between the edges 18 and 19 on either side of the container 10 and a pair of generally horizontally disposed covers 21 cover the front portion of the container and are pivotally attached to the pivot point 20 in any conventional manner. Thus the covers 21 pivot as shown in FIG. 1 to open the front of the container 10. A second pivot point 24 extends downwardly and perpendicular to pivot point 20 midway between the side walls 13 and 14 and toward the rear of the container to the rear plate 16. Covers 25 are pivotally attached to the pivot 24 at the rear of the container and are easily lifted to permit the deposit of materials into the container as illustrated in FIG. 1.

The upper edge of front plate 15 has a horizontally extending pivot bar 30 attached which extends outwardly from both side plates 13 and 14. At the opposite end of the container assembly 10, a bracket 32 is attached to the upper edge of back plate 16 at its midpoint and contains a pivoting loop or ring 33 seem best in FIGS. 1 and 2.

On each side plate 13 and 14, a generally U-shaped horizontally extending lift housing 35 is attached which may be reinforced by spaced triangular gusset plates 36 at the top and 37 at the bottom. Additionally, upper and lower reinforcing plates 38 and 39 may be provided to tie the gussets 36 and 37 together with the lift housing 35 with the reinforcing plates 38 and 39 attached to the respective side walls 13 and 14 in any conventional manner such as by welding.

As seen in FIG. 3, pads 40 may be provided at the respective corners of the bottom plate 12 as well as a reinforcing strip 41 extending along the bottom plate 12. Again these may be steel pads and a steel reinforcing strip attached to the bottom plate 12 in any conventional manner such as by welding to help support the container on a level surface.

As is also seen in FIGS. 1, 2 and 3, the side plates 13 and 14 and the front and back plates 15 and 16 are all tapered outward from the bottom plate to the top edges. The significance of this will be described hereinafter.

Having thus described the components of the container assembly 10, those skilled in the art will appreciate that the configuration lends itself to back loading trash vehicles which would back up to the front of the container and engage the extensions of the pivot bar 30. A winch and hook assembly, not shown, would then be attached to the ring 33 permitting the entire container assembly 10 to be pivoted upward and tilted approximately 90 degrees around pivot bar 30. In the tilted or emptying position, the covers 21 would pivot open and trash within the container would discharge out through the front of the container and into the truck.

Similarly, the same container can be unloaded by a conventional top loading vehicle whose unloading forks, not shown, would engage the housings 35 on either side of the container 10. Again, the forks engaging the lift housings 35 would enable the container 10 to be lifted and tilted upward and backward over the truck, again permitting the contents of the container to discharge through the pivoting covers 21.

As is apparent from the foregoing description of a preferred embodiment, the present invention provides a waste disposal container which is adapted to be unloaded by the use of either a front loading truck or a rear loading truck with either type vehicle approaching from the same end of the container. The device may be configured dimensionally to accommodate conventional front and rear loading vehicles by the location and dimension of the pivot bar 30 for rear loading trucks and by the height and spacing of the side walls and location of the lift housings 35. While the preferred embodiment may be adapted and sized for conventional four or six yard container sizes, the principles would be the same for other sizes as well. Furthermore, by tapering the side and front walls, the raw unfinished containers are capable of being stacked or nested within each other for ease in shipment prior to attachment of the doors and lift housings.

While a preferred embodiment of the invention has thus been described, those skilled in the art will appreciate that other variations are possible. Accordingly, the scope of the invention is to be taken solely from an interpretation of the claims which follow.

We claim:

1. An improved trash container adapted to be emptied by front or rear loading trash hauling vehicles, said container having a bottom and peripheral side walls forming an open receptacle for receiving trash, wherein the improvement comprises:

(a) pivot bar means attached to the upper edge of the front of the container for engaging a stationary pivot point on a rear loading trash hauling vehicle;

(b) lift ring means attached to the upper edge of the rear of the container for engagement with a winch cable to permit said container to be pivoted upward around said pivot bar means when said lift ring means is raised;

(c) bracket means attached to each side wall of said container for engagement with the lift forks of a front loading trash hauling vehicle; and, (d) pivotable cover means for normally covering said container when in an upright position and adapted to pivot to an open position when said container is tipped.

2. A trash container as set forth in claim 1, wherein said cover means comprises at least one cover panel which is pivotable about an axis extending generally parallel to the central axis of said pivot bar means.

3. A trash container as set forth in claim 1, wherein said cover means comprises:

(a) first pivotable cover means for covering a substantial portion of the upper front of said container and being pivotable to open along the front upper edge of said container; and, (b) second pivotable cover means for covering the remainder of the upper rear portion of said container and being pivotable to an open position.

4. A trash container as set forth in claim 1, wherein said pivot bar means comprises a generally horizontal bar having its central axis extending generally parallel to the upper front edge of said container and having its ends extending outwardly from each side of said container.

5. A trash container as set forth in claim 1, wherein said peripheral side walls are tapered upwardly and outwardly from said container bottom.

* * * * *